United States Patent [19]

Jung et al.

[11] Patent Number: 4,664,828

[45] Date of Patent: May 12, 1987

[54] ANTIWEAR ADDITIVES FOR FUNCTIONAL FLUIDS

[75] Inventors: Alfred K. Jung, Millwood; Geralyn Mullin, Mount Vernon, both of N.Y.

[73] Assignee: Stauffer Chemical Company, Westport, Conn.

[21] Appl. No.: 727,168

[22] Filed: Apr. 25, 1985

[51] Int. Cl.[4] ..... C10M 137/04

[52] U.S. Cl. ..... 252/49.8; 252/32.5; 252/78.5; 252/79

[58] Field of Search ..... 252/49.8, 325, 78.5, 252/79

[56] References Cited

U.S. PATENT DOCUMENTS

| | | | |
|---|---|---|---|
| 2,847,443 | 8/1958 | Hechenbleikner et al. | 260/461 |
| 2,899,455 | 8/1959 | Coover et al. | 260/461 |
| 2,903,474 | 9/1959 | Lanham | 252/78.5 |
| 2,916,508 | 12/1959 | McConnell | 260/461 |
| 3,047,608 | 7/1962 | Friedman et al. | 260/461 |
| 3,053,878 | 9/1962 | Friedman et al. | 260/461 |
| 3,141,032 | 7/1964 | Friedman | 252/49.8 |
| 3,152,164 | 10/1964 | Oswald | 260/461 |
| 3,839,506 | 10/1974 | Heckenbleikner et al. | 252/49.8 |
| 3,887,655 | 6/1975 | Shim | 260/397 |
| 3,969,437 | 7/1976 | Shim | 260/397 |
| 3,984,502 | 10/1976 | Shim | 260/986 |
| 3,991,019 | 11/1976 | Shim | 260/25 |
| 4,177,154 | 12/1979 | Chakrabarti | 252/49.8 |
| 4,362,634 | 12/1982 | Berens | 252/49.8 |
| 4,373,103 | 2/1983 | Jung | 544/195 |
| 4,424,172 | 1/1984 | Halpern | 260/937 |
| 4,532,057 | 7/1985 | Aorodysky et al. | 252/49.8 |
| 4,612,128 | 9/1986 | Uemstsu et al. | 252/49.8 |

FOREIGN PATENT DOCUMENTS 476267 5/1975 U.S.S.R. .

OTHER PUBLICATIONS

"Pentaerythritol Phosphite Condensation Polymers" by L. Friedman and H. Gould, *Am. Chem. Soc., Div. Polymer Chem., Preprints* 4 (2), 98–101 (1963) (Eng.).

CAS Reference CA65:10719c.

"Plurasafe Hydraulic Fluid" Technical Bulletin by BASF Wyandotte Corporation.

"Cyclic Phosphites of Some Aliphatic Glycols" by H. J. Lucas et al., *J.A.C.S.* (Dec., 1950), pp. 5491–5497.

*Primary Examiner*—William R. Dixon, Jr.

*Assistant Examiner*—Margaret B. Medley

[57] ABSTRACT

Certain heretocyclic hydrogen phosphonates are disclosed as having utility in functional fluids, particularly synthetic lubricants and/or water-based functional fluids. Antiwear characteristics and other properties are improved by the blending of additives such as spiro-bis-hydrogen phosphonate and cycloneopentyl hydrogen phosphonate with non-petroleum base stocks such as water, phosphate esters, and mixed polyalphaolefins/-polyol esters. Preferred formulations are disclosed.

32 Claims, No Drawings

ANTIWEAR ADDITIVES FOR FUNCTIONAL FLUIDS

BACKGROUND OF THE INVENTION

1. Field of the Invention

This invention relates to the use of specific heterocyclic hydrogen phosphonates as antiwear additives in functional fluids, and the compositions thereby obtained. More particularly, the invention relates to the use of spiro-bis-hydrogen phosphonate and cycloneopentyl glycol hydrogen phosphonate and related products. The functional fluids are particularly synthetic lubricants and/or water-based fluids (rather than petroleum-based products).

2. Prior Art

The use of antiwear additives in functional fluids is extremely old in the art. Spiro-bis-hydrogen phosphonate and cycloneopentyl glycol hydrogen phosphonate are both known in various physical forms. However, neither compound is now known to have been actually used as an antiwear additive in a non-petroleum based functional fluid.

Spiro-bis-hydrogen phosphonate (hereinafter "Compound A") is indexed by Chemical Abstracts Service (CAS) under the name pentaerythritol diphosphite and Register No. 2723-44-6. CAS has apparently indexed only three references, according to a computer search. These are discussed below.

Russian Pat. No. 476,267 describes spiro-bis-hydrogen phosphonate as being a useful intermediate for insecticides and flame-proofing agents. The patent includes a method of preparation that is quite similar to the method used herein. It gave a 100% yield of a white crystalline powder melting at 90°-95° C. (in contrast to about 170° C. in Examples 1B-1D hereinafter).

The CAS reference CA65:10719c is apparently a miscite.

"Pentaerythritol Phosphite Condensation Polymers" by L. Friedman and H. Gould in *Am. Chem. Soc., Div. Polymer Chem., Preprints* 4(2), 98-101(1963)(Eng) is primarily directed to polymers intended for flame retardant applications. In general, "many of these polymers have interesting properties but were too unstable towards moisture to be effective as materials of construction". However, "they are quite effective as additives in stabilizing other polymer systems, such as polyethylene . . . against oxidative and thermal degradation". All of the polymers were prepared from raw materials including diphenyl pentaerythritol diphosphite, rather than pentaerythritol diphosphite. At least three of the references cited by Friedman and Gould are of interest. In particular, see U.S. Pat. No. 3,053,878 (Friedman and Gould); U.S. Pat. No. 3,047,608 (Friedman and Gould); and U.S. Pat. No. 2,847,443 (Hechenbleikner and Lanoue). However, they do not appear to disclose or suggest the invention claimed hereinafter.

Cycloneopentyl glycol hydrogen phosphonate (hereinafter "Compound B") is old in the art. Three U.S. Patents are discussed below.

U.S. Pat. No. 3,152,164 (Oswald) relates to the preparation of compounds such as Compound B by transesterification of a phosphite diester with a glycol. Oswald suggests that the cyclic organic phosphorus compounds of his invention will be of particular advantage due to their increased thermal and hydrolytic stability as petroleum additives themselves or can be used as starting materials for the preparation of additives (see Col. 2, lines 65-69).

U.S. Pat. No. 2,916,508 (McConnell) describes the preparation of Compound B (shown at Col. 2, line 10). The proposed enduses are merely insecticides, stabilizers for polyesters and artificial resins, fungicides, and other related uses.

U.S. Pat. No. 2,899,455 (Coover et al.) concerns derivatives of Compound B obtained by addition-type reactions. The derivatives are described as being useful as pesticides, plasticizers, solvents, flame-proofing agents and intermediates.

Essentially, nowhere does the now-known aforementioned prior art disclose or suggest that Compound A or Compound B or closely related compounds have utility in water-based functional fluids or synthetic functional fluids.

SUMMARY OF THE INVENTIOn

In contrast to the aforementioned prior art it has now been discovered that certain species of hydrogen phosphonate are eminently suitable for use as additives in water-based functional fluids. Some of the species suitable for water-based applications are also suitable for synthetic functional fluid applications. The broadest aspects of the invention are described in the independent claims hereinafter.

DESCRIPTION OF THE PREFERRED EMBODIMENTS

The preferred embodiments of the invention are shown in the claims hereinafter. They are illustrated by the Examples below contrasted to both the prior art and the Comparatives Examples below.

The process of this invention reduces the wear in apparatus having moving parts separated by a functional fluid that is at least 90 percent by weight a non-petroleum base stock, B. It comprises dispersing in B up to 10 percent by weight of an additive comprising a first heterocyclic compound, C1, or a second heterocyclic compound, C2, or mixtures thereof.

Numerous non-petroleum base stocks may be used in this invention. Numerous heterocyclic compounds C1 and/or C2, likewise may be used. It is normally required that the additive C1 and/or C2 be capable of dissolving in B, since this simplifies dispersion.

Preferred variants of B include neat water-based systems; phosphate ester bases; and mixed polyalphaolefin/polyol ester bases.

A preferred variant of C1 is spiro-bis-hydrogen phosphonate (Compound A) which has the following structural formula:

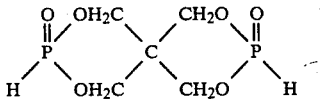

A preferred variant C2 of cycloneopentyl glycol hydrogen phosphonate (Compound B) having the following structural formula:

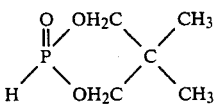

In general, C1 has the following structural formula:

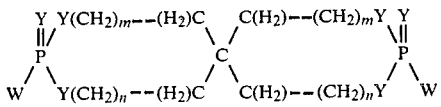

wherein:

Y is oxygen or sulfur;

W is hydrogen or an alkali metal; and m, n, and m plus n, all have values of 0, 1, 2, 3 or 4.

In general, C2 has the following structural formula:

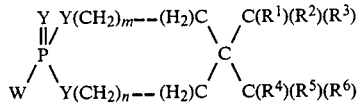

wherein:

Y, W, m, and n are as defined for C1; and $R^1$–$R^6$ are individually selected from hydrogen and saturated hydrocarbyl radicals containing from one to 10 carbon atoms.

Methods for preparing Compound A and Compound B are given in the Examples below. Method for preparing other variants of C1 and C2 respectively may be obvious variants of the foregoing method of preparing Compound A and Compound B, as indicated below.

Compounds wherein Y is sulfur rather than oxygen may be prepared by substituting 1 mole of $P_2S_5$ for each 2 moles of $PCl_3$ and using an appropriate catalyst.

Compounds wherein W is an alkali metal such as sodium or potassium, rather than hydrogen, may be prepared by reacting Compound A and/or Compound B with the appropriate metal hydride.

Compounds wherein m, n, and m plus n have values of 1, 2, 3, or 4, may be prepared by replacing pentaerythritol by the corresponding tetrahydroxyl compound.

Compounds wherein $R^1$–$R^6$ are saturated hydrocarbyl radicals rather than hydrogen may be prepared according to the process for preparing Compound B except that 2,2-dimethyl-1,3-propanediol is replaced by the corresponding dialkyl-1,3-propanediol.

The preferred combined amount of C1 and C2 in this invention is a maximum of 5 weight percent. More preferably, it is in the range from 0.5 to 2.5 weight percent. Optimum values within these ranges will depend upon the remaining constituents of the functional fluid.

It should be noted that both Compound A and Compound B hydrolyze slowly in the presence of water. Accordingly, when B is water, it will be necessary to replenish or replace the functional fluid periodically. In practice, this does not pose a problem for many applications.

Preparation of Compounds A and B

Compound A was prepared in a manner similar to that given in the CAS abstract of aforementioned Russian Patent No. 476,267. The synthesis involved esterification of pentaerythritol with $PCl_3$ to form the spiro-bis chloro phosphite in near quantitive yield. The esterification was run in $CHCl_3$ solvent with a catalytic quantity of pyridine. The intermediate chlorophosphite was not isolated but treated with t-butanol at 25° C. to give a near quantitative yield of the hydrogen phosphonate. The product was merely filtered from the reaction solution and dried. An earlier experiment under similar conditions indicated that the hydrogen phosphonate was an off-white powder with a m.p. of 172°–175° C. (in contrast to 92°–95° C. as reported in the Russian patent). $^{31}$P-NMR analysis indicated one phosphorus environment. H-NMR indicated P-H and ring protons in a 1:4 ratio respectively. IR showed no OH absorption but a strong P-H bond at 2440 $cm^{-1}$. Titration for $P^{III}$ indicated 98.3% of theory.

Compound B was prepared essentially according to aforementioned McConnell's U.S. Pat. No. 2,916,508, Example 2.

Solubility of Compound A and B

Compounds A and B were evaluated for solubility in various functional fluids at room temperature. Compound A was found to be soluble in water, but insoluble in petroleum based oil. Compound B was found to be insoluble in paraffinic oil; but soluble in phosphate ester, polyol ester (short chain), polyalphaolefins, and water.

Comparative Antiwear and Load Bearing Trials

Four comparative trials were performed. Within each trial of several experiments, (1) Compound A or Compound B or a possible competing compound was conventionally dissolved in a given base stock; and (2) the resultant solutions were evaluated for antiwear properties by ASTM D-2266 and/or extreme pressure properties by ASTM D-2783 and/or oxidation corrosion data by Federal Test Method Procedure 791B (Method 5308.6). The base stocks used in these trials were as follows:

(i) Neat High Water Based System

PLURASAFE P 1200 Hydraulic Fluid Concentrate was obtained from BASF Wyandotte Corporation. According to BASF's Technical Bulletin (dated 1983 or earlier) PLURASAFE P 1200 Hydraulic Fluid may be made by adding 1 part of the concentrate to 9 parts of tap water, and stirring with a Lightnin' Mixer or other comparable device. This was done except that distilled water was used. The technical Bulletin states that the so-diluted concentrate is a thickened high water hydraulic fluid ready to use. It has undefined vapor-phase corrosion protection, lubricant additives and anti-corrosive additives as part of its formulation. PLURASAFE P 1200 Hydraulic Fluid is stated to overcome the deficiencies of unthickened high water fluids which are due to low viscosity. Unthickened fluids tend to exhibit low efficiency at high pressure, high leakage rates, and the wire-draw type of erosion.

Typical characteristics of ready-to-use PLURASAFE P 1200 Hydraulic Fluid include the following:

| | |
|---|---|
| Specific Gravity, 100° F. | 0.999 |
| Viscosity at 100° F., SUS | 200 ± 50 |
| Freezing Point, °F. | 32 |
| Boiling Point °F. | 212 |
| pH at 25° C. | 9.8 ± 0.2 |
| Reserve Alkalinity | |
| ml 0.1 N HCl/10 ml sample | 5.6 |
| (ml 0.IN HCl/50 ml sample) | 25–30 |
| Flash Point | None |
| Color | Hazy blue |
| Odor | Fruity odor |

The Technical Bulletin also indicates that the optimum temperature for use of PLURASAFE P 1200

Hydraulic Fluid is 100° F. However, any temperature between 80° F. and 120° F. is acceptable.

(ii) Phosphate Ester Base

The phosphate ester base was essentially t-butylphenyldiphenyl phosphate (Stauffer Chemical Company's SOA-8478).

(iii) Mixed Polyalphaolefin/Polyol Ester Base

This base was prepared by conventionally blending four parts of poly-alpha-decene (obtained from Mobil Corporation as a 6 cst fluid) with one part by weight of trimethylolpropane triheptanoate (Stauffer Chemical Company's Base Stock 704).

TRIAL 1

Compound A/Neat High Water Based System

In Examples 1A (Comparative), 1B, 1C, and 1D, respectively, Compound A was dissolved in the neat high water based system at concentrations of 0; 0.5; 1.0; and 2.0 weight percent. The wear preventive characteristics (four ball method) were determined under ASTM D 2266 procedures at 40 kg load, room temperature, for 1 hour, at speeds of (i) 600 RPM and (ii) 1800 RPM. The wear scars obtained are shown in Table 1 below.

TABLE 1

| Ex. No. | Compound A (wt. %) | Wear Scar (mm) at 600 RPM | Wear Scar (mm) at 1800 RPM |
|---|---|---|---|
| 1A (Comp) | 0 | 0.84 | 1.14 |
| 1B | 0.5 | 0.75 | 0.88 |
| 1C | 1.0 | 0.65 | 0.94 |
| 1D | 2.0 | 0.65 | 1.04 |

The weld point of Example 1A (Comp) was only 80 kg in contrast to 126 kg of Example 1C (as tested in accordance with ASTM D-2783).

TRIAL 2

Compound B/Neat High Water Based System

Trial 2 was similar to Trial 1 except that Compound B was substituted for Compound A. The wear preventive characteristics are shown in Table 2.

TABLE 2

| Ex. No. | Compound B (wt. %) | Wear Scar (mm) at 600 RPM | Wear Scar (mm) at 1800 RPM |
|---|---|---|---|
| 2A | 0.0 | 0.84 | 1.14 |
| 2B | 0.5 | 0.75 | 0.87 |
| 2C | 1.0 | 0.70 | 0.90 |
| 2D | 2.0 | 0.70 | 0.94 |

TRIAL 3

Compound B/Phosphate Ester Base

Compound B was compared with three prior art compounds as an additive in the phosphate ester base, as shown in Table 3 below. The wear scar test was carried out according to ASTM D 2266 at 600 RPM, 40 kg, for three sequential 30 minute runs.

TABLE 3

| Ex. No. | Additive | Wear Scar (mm) 200° F. | 400° F. | 500° F. | 550° F. |
|---|---|---|---|---|---|
| 3A(Comp) | None | .63 | .73 | .93 | .81 |
| 3B | 1 wt % cpd. B | .58 | .62 | .62 | 1.2 |
| 3C(Comp) | 1 wt % Dibutyl Phosphite | .60 | .75 | 1.2 | 1.4 |

TABLE 3-continued

| Ex. No. | Additive | Wear Scar (mm) 200° F. | 400° F. | 500° F. | 550° F. |
|---|---|---|---|---|---|
| 3D(Comp) | 1 wt % Diphenyl Phosphite | .63 | .88 | 1.3 | 1.2 |
| 3E(Comp) | 1 wt % Zinc Dialkyl Dithiophosphate | .49 | .73 | .87 | 1.3 |

TRIAL 4

Compound B/Mixed Pao/Polyol Ester

Compound B was compared with two prior art compounds as an antiwear additive in the mixed polyalphaolefin/polyol ester base. The wear test was carried out under ASTM D 2266 at 600 RPM, 40 kg load, for one hour at the temperatures indicated in Table 4A below.

TABLE 4A

| Ex. No. | Additive | Wear Scar (mm) 225° F. | 275° F. | 300° F. |
|---|---|---|---|---|
| 4A(Comp) | None | .55 | .60 | .46 |
| 4B | 1 wt. % Cpd. B | .48 | .47 | .41 |
| 4C(Comp) | 1 wt % Dibutyl Phosphite | .52 | .55 | .57 |
| 4D(Comp) | 1 wt % Zinc Dialkyl Dithiophosphate | .45 | .49 | .49 |

The blends were also tested according to ASTM D-2783 for Last Non Seizure Point (LNS); Weld Point (WP); and Load Wear Index (LWI). The results are shown in Table 4B below.

TABLE 4B

| Ex. No. | LNS | WP | LWI |
|---|---|---|---|
| 4A(Comp) | 20 | 100 | 11.1 |
| 4B | 32 | 160 | 32.4 |
| 4C(Comp) | 20 | 126 | 34.7 |
| 4D(Comp) | 32 | 126 | 20.9 |

What we claim is:

1. A process for reducing the wear in apparatus having moving parts separated by a functional fluid that is at least 90 percent by weight a non-petroleum base stock, B, which comprises dispersing in B up to 10 percent by weight of an additive comprising a first heterocyclic compound, C1, or a second heterocyclic compound, C2, or mixtures thereof, all wherein:

(i) the first heterocyclic compound, C1, is a spiro compound with two rings with a common tetravalent spiro atom, with the spiro atom being a carbon atom that is directly bonded to four other carbon atoms; wherein C1 has the structural formula:

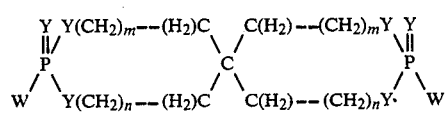

wherein:

Y is a divalent atom selected from oxygen and sulfur:

W is a monovalent atom selected from hydrogen and alkali metals;

m, n, and m plus n, all have values of 0, 1, 2, 3 or 4; and (ii) the second heterocyclic compound C2, has the structural formula:

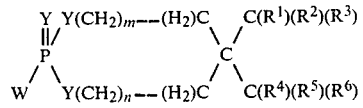

wherein; Y, W, m, and n are as defined for C1; and $R^1$-$R^6$ are individually selected from hydrogen and saturted hydrocarbyl radicals containing from one to 10 carbon atoms.

2. The process of claim 1 wherein B is water and C1 is present in an amount of at least 0.1%.

3. The process of claim 2 wherein the functional fluid has a wear scar of less than 0.80 mm when tested under ASTM D 2266 at 600 RPM, 40 kg load, room temperature, for one hour.

4. The process of claim 3 wherein the wear scar is less than 0.70 mm.

5. The process of claim 2 wherein the functional fluid has a wear scar of less than 1.00 mm when tested under ASTM D 2266 at 1800 RPM, 40 kg load, room temperature, for one hour.

6. The process of claim 5 wherein the wear scar is less than 0.90 mm.

7. The process of claim 1 wherein B is water and C2 is present in an amount of at least 0.1 weight percent.

8. The process of claim 7 wherein the functional fluid has a wear scar under ASTM D 2266 of less than 0.80 mm at 600 RPM, 40 kg load, room temperature, for one hour.

9. The process of claim 7 wherein the functional fluid has a wear scar under ASTM D 2266 of less than 1.00 at 1800 RPM, 40 kg load, room temperature, for one hour.

10. The process of claim 1 wherein B is a phosphate ester and C2 is present in an amount of at least 0.1 weight percent.

11. The process of claim 10 wherein the functional fluid has a wear scar under ASTM D 2266 of less than 0.60 mm at 600 RPM, 40 kg load, 200° F., for three sequential runs of thirty minutes.

12. The process of claim 10 wherein the functional fluid has a wear scar of less than 0.70 mm under ASTM D 2266 at 600 RPM, 40 kg load, 400° F., for three sequential runs of thirty minutes.

13. The process of claim 10 wherein the functional fluid has a wear scar of less than 0.90 mm under ASTM D 2266 at 600 RPM, 40 kg load, 500° F., for three sequential runs of thirty minutes.

14. The process of claim 1 wherein B is a mixed polyalphaolefin/polyol ester and C2 is present in an amount of at least 0.1 weight percent.

15. The process of claim 4 wherein the functional fluid has a wear scar of less than 0.50 mm under ASTM D 2266 at 600 RPM, 400 kg load, 225° F., for one hour.

16. The process of claim 14 wherein the functional fluid has a wear scar of less than 0.45 mm under ASTM D 2266 at 600 RPM, 40 kg load, 300° F., for one hour.

17. The process of claim 1 wherein C1 is a bis compound.

18. The process of claim 1 wherein Y is oxygen.

19. The process of claim 1 wherein Y is sulfur.

20. The process of claim 1 wherein W is hydrogen.

21. The process of claim 1 wherein W is sodium.

22. The process of claim 1 wherein W is potassium.

23. The process of claim 1 wherein m is zero.

24. The process of claim 1 where m is zero and n is zero.

25. The process of claim 1 wherein $R^1$-$R^6$ are all hydrogen.

26. The process of claim 1 wherein C1 has a melting point of at least 150° C.

27. The process of claim 1 wherein C1 is present in an amount of less than 5% by weight.

28. The process of claim 27 wherein C1 is present in an amount in the range of from 0.5 to 2.5 weight percent.

29. The process of claim 1 wherein C2 is present in an amount of less than 5 weight percent.

30. The process of claim 29 wherein C2 is present in an amount within the range from 0.5 to 2.5 weight percent.

31. The process of claim 1 wherein the functional fluid is essentially halogen-free.

32. An improved functional fluid comprising a nonpetroleum base stock, B, in an amount of at least 90 weight percent, wherein the improvement comprises the functional fluid comprises up to 10 weight percent of a first heterocyclic compound, C1, or a second heterocyclic compound, C2, or mixtures thereof, all wherein:

(i) the first heterocyclic compound, C1, is a spiro compound with two rings with a common tetravalent spiro atom, with the spiro atom being a carbon atom that is directly bonded to four other carbon atoms; wherein C1 has the structural formula:

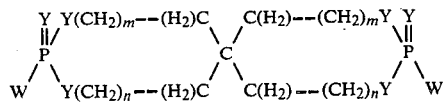

wherein:

Y is a divalent atom selected from oxygen and sulfur:

W is a monovalent atom selected from hydrogen and alkali metals;

m, n, and m plus n, all have values of 0, 1, 2, 3 or 4; and (ii) the second heterocyclic compound C2, has the structural formula:

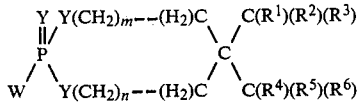

wherein:

Y, W, m, and n are as defined for C1; and $R^1$-$R^6$ are individually selected from hydrogen and saturated hydrocarbyl radicals containing from one to 10 carbon atoms.

* * * * *

UNITED STATES PATENT AND TRADEMARK OFFICE

CERTIFICATE OF CORRECTION

PATENT NO. : 4,664,828

DATED : May 12, 1987

INVENTOR(S) : Alfred K. Jung et al.

It is certified that error appears in the above-identified patent and that said Letters Patent are hereby corrected as shown below:

Col. 3, line 25, "Method" before "for" should read --Methods--;

Col. 3, line 27, "method" after "foregoing" should read --methods--;

Col. 4, line 14, "Compound" before "A and B" should read --Compounds--;

Col. 4, line 63, "0.IN" should read --0.1N--;

Col. 7, line 11, "saturted" should read --saturated--;

Col. 7, line 55, "claim 4" after "of" should read --claim 14--; and

Col. 8, line 28, "comprises" after "fluid" should read --comprising --.

Signed and Sealed this

First Day of September, 1987

*Attest:*

*Attesting Officer*

DONALD J. QUIGG

*Commissioner of Patents and Trademarks*